United States Patent [19]

Foshee

[11] 4,437,695

[45] Mar. 20, 1984

[54] KNOB RETAINER BLOCKER MECHANISM

[75] Inventor: William R. Foshee, Indianapolis, Ind.

[73] Assignee: Best Lock Corporation, Indianapolis, Ind.

[21] Appl. No.: 338,091

[22] Filed: Jan. 8, 1982

[51] Int. Cl.[3] ..... E05C 21/00

[52] U.S. Cl. ..... 292/352; 292/169.16

[58] Field of Search ... 292/352, 353, 359, 169–169.23; 70/368

[56] References Cited

U.S. PATENT DOCUMENTS

| | | | |
|---|---|---|---|
| 2,062,765 | 12/1936 | Schlage | 292/352 X |
| 2,517,240 | 8/1950 | Roberts | 292/353 |
| 2,814,194 | 11/1957 | North et al. | 292/169.17 X |
| 3,026,136 | 3/1962 | Russell et al. | 292/336.3 |
| 3,779,590 | 12/1973 | Sanders et al. | 292/336.3 |
| 3,955,387 | 5/1976 | Best et al. | 292/352 X |

FOREIGN PATENT DOCUMENTS

| | | | |
|---|---|---|---|
| 1119714 | 12/1961 | Fed. Rep. of Germany | 292/353 |

OTHER PUBLICATIONS

Drawings and Abstract of application Ser. No. 326,483, filed 12/2/81.

*Primary Examiner*—Richard E. Moore

*Attorney, Agent, or Firm*—Barnes & Thornburg

[57] ABSTRACT

A door lock mechanism in which the outside knob is seamed against knob retainer, the retainer is diametrically slidable in the knob sleeve and has a specially shaped opening which defines a thrust-receiving edge for engagement by a spring which straddles a central area of the opening, and which has side borders which project toward each other and define blocker engaging surfaces between the legs of the spring. In a cylinder lock, a blocker plunger is preferably carried by a standard type bushing slidable in a standard supplemental cam sleeve, and the plunger is supported close to the retainer by the end wall of such cam sleeve. In a mortise lock, the plunger is similarly supported close to the retainer by a bushing in the knob sleeve.

13 Claims, 5 Drawing Figures

FIG. 4
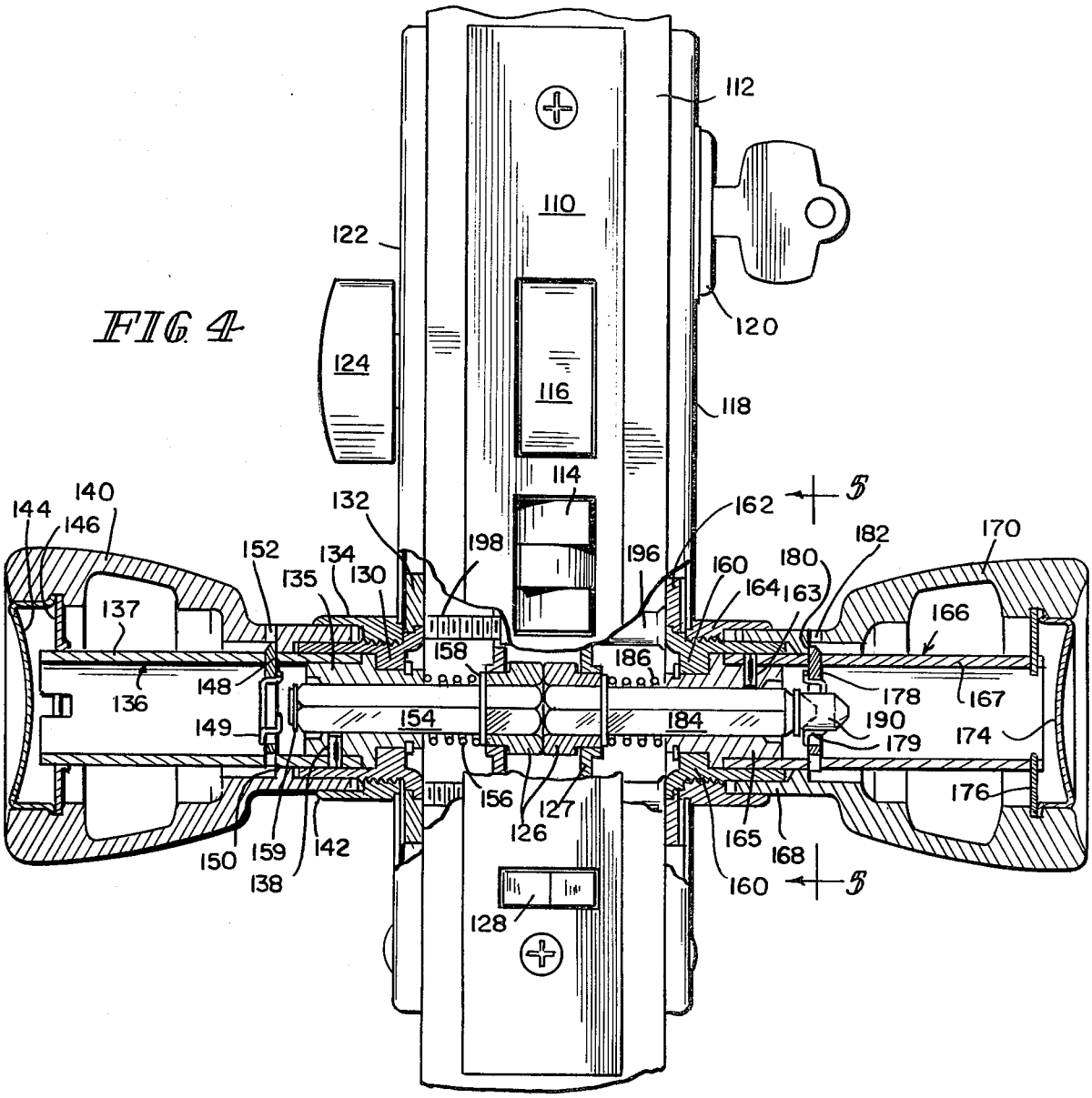
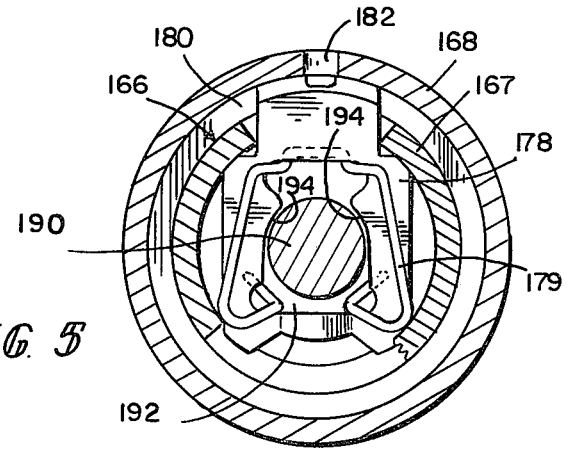
FIG. 5

KNOB RETAINER BLOCKER MECHANISM

This invention relates to door locks of the type having a knob on the outside of the door, and more particularly to mechanism for blocking the release of the retainer which secures the outside knob on its knob sleeve.

In door locks having outside knobs, it is necessary to secure the knob against removal from the outside of the door, both to prevent loss of the knob and also to block unauthorized attempts to operate the lock by first removing the knob. When the outside knob contains a key-actuated core, this has in the past been accomplished by blocking the release of the knob keeper except when a proper key has been used to turn the key-actuated mechanism to a predetermined position. When the key-actuated mechanism is a key-removable core, the knob retainer has been made releasable only after such core has been removed. In Best et al U.S. Pat. No. 3,955,387, a key-removable core is connected to operate the lock through a throw member which blocks release of the knob retainer until both the core and such throw member have been removed. When the outside knob is a closed knob containing no key-controlled mechanism, these expedients are not available, and one common practice has been to secure the knob on the knob sleeve by a retainer which cannot be released without destroying the integrity of the knob or related parts of the mechanism. This has a number of disadvantages. Knobs cannot be replaced or interchanged when desired, and if a knob is damaged, it is not feasible to replace the knob without replacing a major portion or the entirety of the interconnected mechanism. The present invention overcomes this problem by blocking the release of the outside knob retainer at all times when the door is closed and locked, and provides for release of such retainer only after manipulation of parts of the lock from the inside of the door. This protects the outside knob when the door is closed, but provides for ready removal and replacement of the knob when there is proper access to the mechanism at the inside of the door.

In accordance with the invention, the outside knob is retained by a retainer which for release must move inward transversely of the knob sleeve, and such movement is blocked by a blocking plunger or the like mounted in the knob sleeve. The plunger is desirably mounted inward of the retainer and is movable axially of the sleeve between an outward blocking position and an inward release position. The lock mechanism is so arranged that when the outside knob is locked, such blocking plunger will be held in its blocking position, and can be moved to its inward release position only by manipulation by parts of the lock at the inside of the door.

In a cylindrical lock having an inner knob coaxial with the outer knob, it is conventional for some "functions" of the lock to provide the inner knob with a push button or turn button which, when actuated, will move a bushing in the outer knob sleeve to lock the outside knob and knob sleeve against operative rotation. In such lock sets, the blocking plunger of the present invention may be biased to its non-blocking position and moved to its blocking position by the same push button or turn button when that button is moved to lock the outside knob against rotation. In other functions of a cylindrical lock, the outer knob is permanently fixed against rotation, in which case the buttons may be used for purposes of the present invention without also controlling the rotation of the knob. Also, the blocker may be held in blocking position by the presence of an inside knob, and made releasable only when the inside knob is removed.

In a mortise lock, it is known to provide the outside knob as part of a chassis assembly in which the knob is mounted on a supporting sleeve which is connected to a coaxial bolt-retracting hub by a spindle which is rotatable with and slidable axially of the knob sleeve, and to bias that spindle toward the hub so that it adjusts itself lengthwise to suit the relationship between the knob chassis and the hub, which varies with the thickness of the door. In accordance with the present invention, such an axially movable spindle is provided with a blocker nose at its outer end, and when the outside knob chassis assembly is mounted against the outside of the door, the spindle is moved to carry such blocker nose into blocking relationship with the knob retainer to prevent release of that retainer. The outside knob chassis is secured by bolts accessible only from the inside of the door, and release of the outside knob will be obtained by release of those clamping screws to allow the outside knob chassis to move away from the mortise case at least far enough to allow axial movement of the spindle and its blocker nose to a position in which the blocker nose is withdrawn from the knob retainer and permits that knob retainer to be retracted to a knob-releasing position.

The accompanying drawings illustrate the invention, and show embodiments exemplifying the best mode of carrying out the invention as presently perceived. In such drawings:

FIG. 4 is a door-edge elevation of a mortise lock installation, with the two knob subassemblies and a portion of the mortise lock mechanism shown in section; and FIG. 5 is a section taken on the line 5—5 of FIG. 3.

Figure 1:
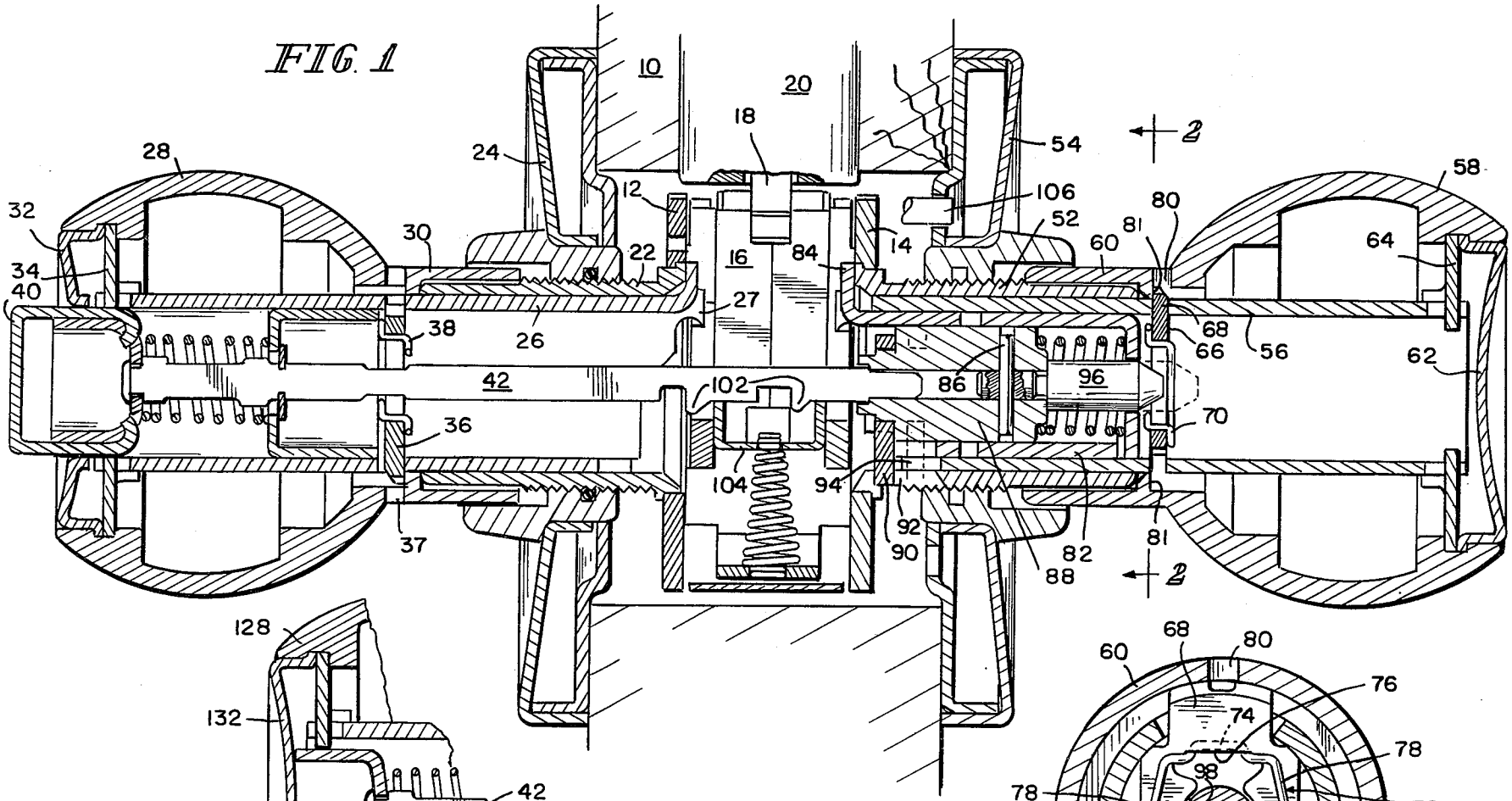
FIG. 1 is a horizontal axial section of a cylindrical lock embodying the present invention.
Figure 2:
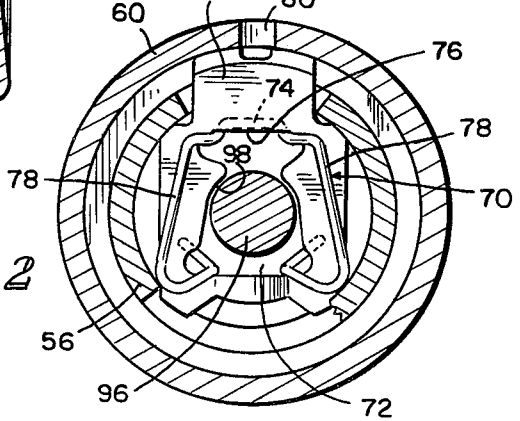
FIG. 2 is a section taken on the line 2—2 of FIG. 1, but with the knob retainer blocked from retraction.

The cylindrical lock shown in FIGS. 1 and 2 as mounted in a door 10 comprises a chassis having end plates 12 and 14 defining a housing for a retractor 16 connected to retract the tailpiece 18 of a latch tube assembly 20. The inside chassis side plate 12 carries a tubular hub 22, externally threaded for the reception of a trim ring or rose 24. A knob sleeve 26 for the inside knob 28 is rotatably mounted in the hub 22 and projects therebeyond to support the knob 28. Its inner end carries a roll-back cam 27 for retracting the retractor 16. The knob preferably has a neck portion 30 which telescopes over the outer end of the hub 22 and is received within a collar on the rose assembly 24. The knob 28 is a hollow knob with a large end opening closed by a face plate 32 which is pressed in place against a drive ring 34 in a manner which locks the face plate in the end opening of the knob, as shown in U.S. Pat. No. 3,955,387. The drive ring 34 drivingly connects the knob 28 to the outer end of the knob sleeve 26 by tabs which extend into end notches in that knob sleeve and are outwardly separable therefrom. The inside knob 28 is retained in place by a knob retainer 36 transversely slidable in the knob sleeve and biased to a projected position by a biasing spring 38, and manually retractable with a tool inserted through an access hole 37. The biasing spring is like that shown in FIG. 2 and described below in connection with the outer knob retainer. The end face 32 contains a push button 40 biased outward and manually operable to actuate a locking bar 42 for locking the outside knob, as will be described.

The outside chassis side plate 14 carries a fixed hub 52, externally threaded for the reception of a trim ring or rose assembly 54. An outer knob sleeve 56 for an outer knob 58 is rotatably mounted in the hub 52 and has at its inner end an out-turned roll-back cam (not shown in this section) for camming the retractor 16 rearward to retract the bolt of the latch bolt assembly 20. A neck portion 60 of the knob telescopes over the hub 52 and lies within a collar on the rose 54. The knob 58 is a hollow knob formed with a large end opening, and such opening is closed with an end plate 62 pressed into place against a drive plate 64 having inner tabs engaged in notches in the end of the knob sleeve 56 to drivingly connect the knob to the knob sleeve. The knob is held on the knob sleeve by a knob retainer 66 mounted transversely of the knob sleeve in diametrically opposite slots therein and having a projecting lug portion 68 with a bevelled end which engages behind the radial face 81 of an internal rabbet groove at the juncture between the hand-hold portion of the knob 58 and the neck 60. The retainer 66 is biased to engaged position by a spring 70.

As shown in FIG. 2, the retainer 66 is formed with a central opening 72, and the spring 70 is a generally U-shaped spring similar to that shown in co-pending application Ser. No. 163,472, filed June 27, 1980, now U.S. Pat. No. 4,342,478, issued Aug. 3, 1982. Such spring has a hooked bight portion 74 interengaged with and against a forward thrust-receiving border 76 of the opening 72 and having legs 78 extending in splayed relation across the knob sleeve 56 into engagement with forwardly diverging inner side faces of that knob sleeve. The legs are stressed to exert force outward against such surfaces and thereby cam the spring toward the thrust-receiving border 76 and thereby bias the knob retainer 66 to its knob-retaining position as shown. Opposite the end of the knob retainer lug 68, the neck 60 of the knob is formed with an access opening 80 through which a tool may be inserted against a flat on the end of the lug to push it inward against the bias of the spring to a retracted, knob-releasing position. When the knob is locked against rotation, as when the door is closed and locked, such retraction of the knob retainer is blocked, as will be described. In the relationship of the parts as shown in full lines in FIG. 1, however, the knob is free to be turned to retract the bolt, and such blocking action does not occur.

The inner end of the knob sleeve 56 contains a supplementary roll-back cam sleeve 82 having an out-turned roll-back cam 84 at its inner end in position to cam the retractor 16 rearward. For purposes of the present invention, the arrangement is such that the supplemental cam sleeve 82 and the knob sleeve 56 rotate together.

For purposes of locking the outside knob 58 and its knob sleeve 56 against rotation, a bushing 88 is slidably mounted within the knob sleeve 56, in this case, in the supplementary cam sleeve 82. The inner end of the bushing 88 is of reduced diameter and carries a locking finger 90 which, in the position shown, extends outward across the end of the knob sleeve 56 into a notch 92 formed at the base of the outside hub 52. In this position, it lies across a flat end portion of the knob sleeve 56, in clearance relation therewith, so that such knob sleeve 56 is free to rotate relative to the hub 52. Movement of the bushing 88 and its locking finger 90 axially from its full-line position to the dotted-line position shown will carry such locking finger into a notch 94 in the end of the knob sleeve 56, and thereby lock that knob sleeve 56 to the fixed hub 52. The knob sleeve 56 and the outside knob 58 will then be locked against rotation, as is known in the art.

In accordance with the present invention, the bushing 88 carries at its inner end a cylindrical plunger 96, held by a pin 86. The plunger lies clear of the knob retainer 80 when the bushing 88 is in its retracted position shown in full lines in FIG. 1. When the bushing 88 is moved to its knob-locking position, such plunger moves to a blocking position in which it extends through the knob retainer 66, as shown in dotted lines in FIG. 1 and in cross section in FIG. 2. The central opening 72 in the knob retainer 66 has its side borders formed with inward projections which define inner cylindrical faces 98 in position to engage the projected plunger 96 to block movement of the knob retainer to a knob-releasing position and thus to prevent the knob keeper 66 from being thrust inward toward a knob-releasing position.

In the cylindrical lock as shown in FIGS. 1 and 2, the position of the bushing 88 and the blocking plunger 96 is controlled by the push button 40 in the inside knob 28. Such push button is connected to a locking bar 42 which extends into thrust relation with the bushing 88. Both such button 40 and bushing 88 are biased toward retracted position by biasing springs, as shown, and will normally be in their retracted positions as shown in full lines in FIG. 1. When the push button 40 is thrust inward, the locking bar 42 is moved endwise to move the bushing from its release position shown in full lines in FIG. 1 to its knob-locking position shown in dotted lines. In such position, the locking finger 90 locks the knob sleeve 56 to the hub 52 to prevent knob rotation, and the blocker plunger 96 projects through the opening 72 in the knob retainer 66 so as to lie in the path of the shoulders 98 of the knob retainer and prevent retraction of that knob retainer. For purposes of holding the bushing 88 and blocker plunger 96 in actuated position, the locking bar 42 is provided with a pair of nose cams 102 which ride across the edges of a catcher plate 104 carried by the retractor 16. The catcher plate 104 is spring-pressed toward the bar 42, and when such nose cams pass the edges of the catcher bar, such edges drop into notches behind the nose cams so as to lock the locking bar 42 in advanced position.

Installation of the cylindrical lock set embodiment shown in FIGS. 1 and 2 is carried out by adjusting the outside trim ring or rose 54 along the threads of the outside hub 52 to properly locate the retractor 16 in alignment with the latch tube 20, and locking the rose 54 in adjusted position as by a pin 106 carried by the chassis in known manner. The chassis, with the inside knob 28 and inside rose 24 removed, is then installed through the transverse opening in the door and brought into proper interengagement with the latch tube 20 and tailpiece 18. The inside rose 24 is then threaded onto the inside hub 22, to fix the chassis in place with the door clamped between the two roses 24 and 54. Removal can then occur only by reversing this procedure and removing the rose 24 at the inside of the door. The outside knob 58 is installed on the outside knob sleeve 56, by sliding the neck of the knob over the end of the knob sleeve, in proper orientation to bring its drive ring 64 into interlocking engagement with the notches at the ends of the knob sleeve. As the knob engages the bevelled outer face of the lug 68 of the knob retainer 66, that retainer will be cammed inward against the bias of its spring, and the knob neck will pass across the retainer until the lug 68 passes the bottom end face 81 of the rabbet groove 69, and the retainer 66 will then be moved outward to overlie such face and lock the knob in retained position on the sleeve. The inner knob 28 is similarly mounted on the inner knob sleeve 26.

With the button 40 in its outward position relative to the inner knob 28, as shown in full lines in FIG. 1, the locking rod 42 will be withdrawn, and the bushing 88 in the outer knob sleeve will be in its retracted position so that the locking finger 90 will be disengaged from the notch 94 in the outer knob sleeve 56, and the outer knob will be rotatable to cam the retractor 16 rearward and retract the bolt. With the bushing 88 in retracted position as shown in full lines, the blocker plunger 96 will also be in retracted position, substantially disengaged from the knob retainer 66. Under these conditions, with the outer knob operable to retract the bolt, it is feasible to leave the knob retainer 66 unblocked and operable to release the knob from the knob sleeve.

When the outer knob is locked against rotation, by manually pushing the button 40 inward, the inward movement acts through the locking rod 42 to move the bushing 88 to its actuated position, to the right in FIG. 1, as shown in dotted lines. This carries the locking finger 90 axially into the groove 94 of the outer knob sleeve 56 to lock that knob sleeve to the stationary hub 52 and lock the sleeve and knob against rotation. Concurrently, the movement of the bushing 88 carries the blocking plunger 96 through the plane of the knob retainer 66 to its blocking position as shown in dotted lines in FIG. 1 and in full lines in FIG. 2. The plunger then blocks the knob retainer 66 against inward movement, and it is then not possible to release the outer knob 58 for removal from the knob sleeve. In order to remove the outer knob, it is first necessary to manipulate part of the mechanism at the inside of the door, in this case to release the push button 40 as by rotating the inside knob 28, and allow such button, the locking bar 42, the bushing 88, and the blocking plunger 96 to move to their retracted, full-line positions shown in FIG. 1. The knob retainer 66 then becomes unblocked and the outer knob 58 can be removed by thrusting the knob retainer 66 inward by a suitable tool inserted through the opening 80.

Figure 3:
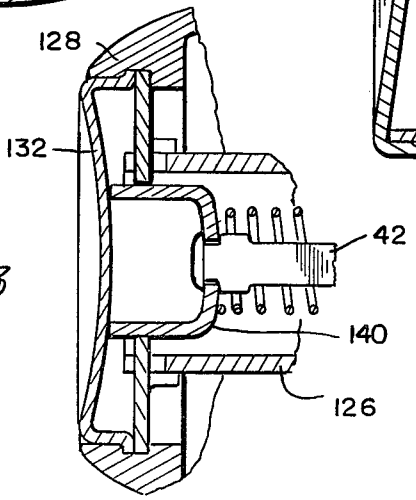
FIG. 3 is a partial section analogous to FIG. 1, but showing a fully closed inside knob which, when it is installed, causes the outside knob retainer to be blocked.

In the modification shown in FIG. 3, the large end opening in the inside knob 128 is completely closed by an end face 132. When such knob is mounted on the inside knob sleeve 126, the end face 132 of the knob comes into engagement with a cup 140 mounted on the end of the locking bar 42 so as to move that bar from its retracted position as shown in full lines in FIG. 1 to its actuated position shown in dotted lines in FIG. 1. This has the effect of moving the blocking plunger 96 into the plane of the outside knob retainer 66 where it will block the retraction of that retainer and prevent removal of the outside knob 58. In this modification, the locking bar 42 and the blocking plunger 96 are in their blocking position at all times when the inside knob 128 is in operative position on the inside knob sleeve 126. Removal of the ouside knob 58 can then occur only by first removing the inside knob 128, which allows the locking bar 42 and cup 140 to move outward from the positions in which they are held by the end face 132 of the outside knob, and hence permits the blocking plunger 96 to move to a retracted position where it will permit actuation of the outside knob retainer to release the outside knob for removal.

The mortise lock embodiment shown in FIGS. 4 and 5 comprises a mortise case 110 mounted in the edge of a door 112 and providing a latch bolt 114 and a dead bolt 116. The lock set includes an outside escutcheon 118 through which a key-operated lock cylinder 120 is mounted to actuate both the dead bolt and the latch bolt 114. An inside escutcheon 122 carries a turnknob 124 connected to operate the dead bolt. The mechanism of the mortise case also includes a pair of coaxial hubs 126 rotatably mounted by end collars received in openings in the side walls 127 and 129 of the case 110. The mortise lock mechanism may be any of a number of conventional mechanisms, and the details are not necessary to an understanding of the present invention. As is known, the hubs 126 are connected to operate retracting mechanism for the latch bolt 114, and such mechanism may include deadlocking mechanism controlled by an auxiliary latch 128 which is depressed by the strike plate when the door is closed.

The two hubs 126 are connected for operation by inside and outside knob assemblies. The inside knob assembly includes a chassis comprising a hub 130 fixed to a side plate 132 adapted to be secured against the inside face of the door and covered by the escutcheon 122. The hub is externally threaded for the reception of a trim ring 134. An inside knob sleeve 136 is mounted for rotation within the hub 130. As shown, such knob sleeve 136 is formed as an assembly of a bushing 135 having a reduced end journalled in the hub 130 and having an outer end which is received in a cylindrical sleeve portion 137 which is pinned to the bushing 135 by a pin 138. An inside knob 140 is mounted by its neck portion 142 on the knob sleeve 136. The outer end of the knob is closed by an end face 144 which is pressed into place against a drive ring 146 which transmits torque between the knob and knob sleeve. The knob is held in place on the knob sleeve by a retainer 148 biased outward into overlying relation with a circular shoulder formed inside the neck, and the neck has a tool insertion opening 152 for insertion of a tool to force the retainer 148 inward to release the inside knob for removal from this knob sleeve.

The knob sleeve 140 and knob sleeve 136 are connected to the adjacent mortise case hub 126 by a square spindle 154. This is slidable in a conforming opening in the bushing 135, and is spring-pressed inward toward and into engagement with the hub 126 by a spring 156 acting between the inner end of the bushing and a snap ring 158 fixed in a groove in the spindle. This general method of mounting a spindle in a mortise lock is known, and provides a self-aligning and self-adjusting connection between the knob assembly and the mortise case adapted to accommodate different thicknesses of doors and tolerances which occur in installation procedures. Accordingly, the spindle 154 has a normal position, when disengaged from a mortise case, in which it extends substantially farther out of the knob assembly and in which it is held by a retainer snap ring 159 engaged in a notch in the turned end of the spindle.

The outer knob assembly comprises a chassis including a hub 160 fixed to an end plate 162 adapted to be secured against the outside face of the door. The outside of the hub is threaded for the reception of a trim ring 164. A knob sleeve 166 is rotatably mounted in the hub 160 and comprises a bushing 165 having its inner reduced end journalled in the hub and having an outer larger end which is received within the inner end of a cylindrical sleeve 167. The two are pinned together by a drive pin 168. An outside knob 170 is mounted on the knob sleeve 166 by a neck portion 168 which is telescoped over the outer end of the hub and is surrounded by the outer end of the trim ring 164. A large end opening in the knob 170 is closed by a face plate 174 which is pressed into place against a drive ring 176 which has inward-extending fingers engaged in notches in the outer end of the knob sleeve for transmitting torque between the knob 170 and the knob sleeve 166. The knob is held in place on the knob sleeve by a retainer 178 mounted for transverse movement in diametrically opposite slots through the wall of such sleeve. The retainer is biased by a biasing spring 179 in a direction to engage its outer end over a circular shoulder 180 formed in the neck portion 168 of the knob. An access opening 182 in the knob neck permits insertion of a tool to retract the retainer 178. The knob and knob sleeve are operatively connected to the adjacent hub 136 of the mortise case by a square spindle 184 which, like the inside spindle, is slidable in the bushing 165 and spring-pressed toward and into engagement with the hub 126 by a spring 186.

In accordance with the present invention, the outer end of the spindle 184 for the outside knob carries a blocker nose 190 which, in the normal position of the spindle when the lock set is mounted to a door as shown, projects from that spindle 184 through a central opening 192 in the outside knob keeper 180. As shown in FIG. 5, such opening 192 is defined by side borders which have inward projections 194 extending toward each other to define portions of a cylindrical surface which lie in close proximity to the side of the blocker plunger 190 and effectively block retraction of the knob retainer 178 from its knob-retaining position as shown in FIG. 4. When the outside knob assembly is separate from the door and an associated mortise case, the spring 186 moves the spindle 184 outward from the outside knob sleeve 166, and carries the blocker plunger 190 out of the plane of the knob retainer 178 so that that knob retainer can be retracted for mounting a knob 170 on the knob spindle 166 and for removing the knob from that spindle.

The two knob assemblies are held against the face of the door by bolts which include an internally threaded sleeve 196 fixed to the base plate 162 of the outside knob chassis. Such internally threaded sleeves 196 on the outside chassis receive screws 198 inserted through the base plate 132 of the inside knob assembly and which are accessible only from the inside of the door.

Installation of a mortise lock embodiment of the invention as shown in FIGS. 4 and 5 involves mounting the mortise case in a suitable mortise in the edge of the door in the usual way. An outside knob and escutcheon assembly is then prepared with the escutcheon engaged loosely over the hub 160 and the trim ring 164 threaded loosely on that hub. Also, a knob 170 is mounted on the knob sleeve 166. With this outside knob and escutcheon assembly still separate from the door and mortise case, the spindle 184 is in its outermost position so that it moves the blocker plunger 190 out of the plane of the knob retainer 178, and this leaves that retainer operable to install and remove the knob from the knob spindle. The knob is installed by pushing it onto the outer end of the knob sleeve 166. When it engages the retainer, bevelled faces on the retainer and knob cause the retainer 178 to be cammed inward to pass the knob onto the sleeve until the retaining shoulder 180 passes the retainer, and the retainer is then moved outward by its biasing spring into its retaining position as shown in full lines in FIG. 4. For removal, a suitable tool is inserted through the opening 182 to force the retainer 178 inward to a knob-release position, but this can occur only when the blocker nose 190 is withdrawn from the retainer.

With the outside knob and escutcheon assembled as indicated, the assembly is then brought against the outside face of the door, and its bolt sleeve portions 196 passed through suitable openings in the mortise case. An inside knob chassis is then mounted against the inside face of the door, and screws 198 are threaded through the base plate 132 into the threaded sleeves 196 to clamp the two face plates solidly against the sides of the door. The inside trim assembly is then completed by installing the escutcheon 122, the trim ring 134, and the knob 140. The key-operated cylinder 120 may be installed in the usual way after the installation of the escutcheons.

As the outside knob assembly is thus assembled to the door, the spindle 184 comes into engagement with the adjacent mortise hub 126, and is forced outward of the door and inward of the knob sleeve 166 to carry its blocker nose 190 into blocking position through the plane of the outside knob retainer 178, and such retainer is then blocked from moving to release position and the knob 170 is securely locked against removal.

Removal of the outside knob then requires a reversal of the installation procedure, and manipulation of lock mechanism at the inside of the door before the outside knob 10 can be removed from its knob spindle. Thus, by removing the inside knob 140, the trim ring 134, and the escutcheon 120, access is obtained to the screws 198 which secure the inside and outside chassis assemblies against the face of the door. Those screws are then released and the outside escutcheon 118 is released from the face of the door, so that the outside knob and escutcheon assembly can be moved away from the door sufficiently to allow the spindle 184 to move axially relative to the knob retainer 178 a sufficient distance to unblock the operation of that knob retainer. The retainer can then be moved to a knob-release position with a tool inserted through the access opening 180, and the outside knob can then be removed from its knob sleeve 166.

What is claimed is:

1. Knob retainer-blocking mechanism for a lock set having inside lock set mechanism and having an outside knob mounted on a knob sleeve, comprising an outside knob retainer movable transversely of the sleeve between a forward knob-retaining position and a rearward knob-release position, said retainer being in the form of a plate mounted for diametrical sliding movement in said sleeve and having a central opening including a thrust-receiving forward border and side borders which define blocker-engaging surfaces at opposite sides of a central area of said opening, a retainer biasing spring having a bight portion in thrust-transmitting engagement with said forward border and having side legs extending into stressed engagement with opposite portions of the knob sleeve and straddling said central area of the retainer plate opening, a blocking plunger mounted for movement axially within the knob sleeve between a blocking position in which it extends through the central area of said retainer plate opening in blocking relation with said blocker engaging surfaces so as to block movement of the knob retainer from its knob-retaining position to its knob-release position and a non-blocking position in which it is withdrawn from said opening and permits such retainer movement, and plunger control means for positioning said plunger in its blocking position when the lock set is installed in a door and is conditioned to prevent lock bolt retraction by the outside knob, said control means being inaccessible from the outside of the door when the door is closed, and said plunger being releasable to its non-blocking position in response to manipulation of the inside lock set mechanism.

2. Lock mechanism as in claim 1 in which said inside lock mechanism includes an inside knob having a manually operable control element therein, said plunger control means comprising said control element and means connecting the same to control the position of the retainer-blocking plunger, such plunger being movable from its blocking position to its unblocking position by manipulation of said control element of the inside lock mechanism.

3. Lock mechanism as in claim 1 in which said plunger control means is operable to position said plunger in its blocking position in response to the presence of inside lock set mechanism in operative installed relation with said outside lock mechanism.

4. Lock mechanism as in claim 3 in which the lock set is a cylindrical lock having an inside knob mounted on a knob sleeve coaxial with the outside knob sleeve and said control means comprises a connecting member held in operative position by the presence of an inside knob on said inside knob sleeve.

5. Lock mechanism as in claim 3 in which the lock set is a mortise lock comprising a mortise case having a rotary bolt-operating hub, an outside knob assembly including said outside knob and knob sleeve, a spindle mounted in coaxial sliding and torque-transmitting relation with said sleeve and adapted to be engaged in said bolt-operating hub to transmit knob sleeve rotation to such hub, said blocking plunger being movable with said spindle and said spindle being movable to a projected position in which the plunger is in a non-blocking position relative to the knob retainer, said outside knob assembly, when in installed position relative to said mortise case with said spindle in operative relation with said bolt-operating hub, being effective to locate said spindle so as to position said plunger in retainer-blocking position, said inside lock mechanism including securing means for securing said outside knob assembly in such installed position so as to prevent movement of said plunger from its retainer-blocking position except only by releasing said securing means of the inside knob chassis assembly.

6. Lock mechanism as in claim 1, further comprising a supplementary sleeve within said knob sleeve at its inner end and having an end wall adjacent the knob retainer, and a bushing slidably mounted in said supplementary sleeve, and connected to said blocking plunger to move the same between its blocking and non-blocking positions, said plunger extending through said end wall in supported relation therewith.

7. Lock mechanism as in claim 6 with the addition of a biasing spring acting between said bushing and said end wall of the supplementary sleeve to bias the bushing and plunger to non-blocking position.

8. Lock mechanism as in claim 1 which includes a supplementary sleeve nested in the inner end of said knob sleeve and having an end wall at its outer end, a bushing slidably mounted in said cam sleeve and a locking finger movable with the bushing between an inward release position and an outward locking position in which it locks the knob sleeve against rotation relative to the hub, said blocking plunger being mounted on said axially slidable bushing and extending in supported relation through the end wall of said cam sleeve, said plunger in the knob-locking outward position of the bushing extending through the plane of the knob retainer in blocking relation therewith to block the movement of the retainer from its knob-retaining position, and said plunger being movable with the bushing to a release position in which it permits movement of the retainer to a knob-release position.

9. A mortise lock, comprising a mortise case including a rotatable hub for operating a bolt and adapted to be mounted in a mortise in a door edge, an outside knob chassis assembly including a chassis having a mounting plate for mounting at the outside face of the door, a knob sleeve rotatable in said chassis and an outside knob removably mounted thereon, and a spindle mounted for sliding and torque-transmitting relation with said knob sleeve, said spindle being adapted to be engaged in said hub and to be held axially in an installed position when the outside chassis assembly is installed in operating relation with the mortise case in the door, said outside knob being retained on its knob sleeve by a retainer movable transversely in said knob sleeve between a projected knob-retaining position and a retracted knob-release position, wherein the improvement comprises a bushing fixed in the inner end of the knob sleeve, the spindle being non-rotatably slidable in said bushing, projecting inward therefrom and having a collar fixed on its inward projecting end in spaced relation with the bushing, a spring between the collar and bushing for biasing the spindle away from the knob, and means on the spindle for engaging the opposite end of the bushing to limit spring-actuated movement of the spindle, a blocker element fixed on the outer end of said spindle, said element, when the spindle is in its installed position, having a blocking position in which it is supported by the bushing in blocking relation with said knob retainer to prevent retraction thereof from its knob-retaining position, and said element being located in a non-blocking position when the spindle is in its retracted position, whereby said retainer is blocked when the outside chassis assembly is in installed position so as to prevent knob removal from the installed lock and said retainer is not blocked when such assembly is removed from installed position so as to allow knob removal from the separated chassis assembly, and means for securing the outside chassis assembly in installed position, said means being inaccessible from the outside of a closed door in which the mortise lock is installed.

10. A cylindrical lock set, comprising:

a chassis including an outside hub, a knob sleeve mounted in said hub and having a roll-back cam at its inner end for actuating a retractor in said chassis, a supplementary sleeve nested in the inner end of said knob sleeve and having an end wall at its outer end, a bushing slidably mounted in said cam sleeve and a locking finger movable with the bushing between an inward release position and an outward locking position in which it locks the knob sleeve against rotation relative to the hub, a knob mounted on said knob sleeve and a knob retainer mounted for transverse sliding movement in the knob sleeve adjacent the end wall of the cam sleeve and having a radially outward knob-retaining position, and an inside knob assembly and manually operable control means associated therewith for positioning said bushing and locking finger in locking position, which lock set includes the improvement comprising:

a blocking plunger mounted on said axially slidable bushing and extending in supported relation through the end wall of said cam sleeve, said plunger in the knob-locking outward position of the bushing extending through the plane of the knob retainer in blocking relation therewith to block the movement of the retainer from its knob-retaining position, and said plunger being movable with the bushing to a release position in which it permits movement of the retainer to a knob-release position.

11. A cylindrical lock set as in claim 10 with the addition of a spring disposed between the end wall of the cam sleeve and the bushing to bias the bushing, the locking finger, and the blocking plunger to release positions.

12. Knob retainer mechanism for a lock set having a knob adapted to be retained on a knob sleeve by a retainer mounted for movement transversely of the knob sleeve, comprising:

a plate-like retainer mounted for diametric sliding movement in the knob sleeve and having a radially outward projecting lug for engagement with a shoulder on the knob for retaining the knob on the sleeve, a central opening in said plate having a thrust-receiving forward border and side borders which define blocker-engaging surfaces at opposite sides of a central area of said opening, a biasing spring having a bight portion in thrust-transmitting engagement with said forward border and having side legs extending in spaced relation into stressed engagement with opposite wall portions of the knob sleeve and straddling said central opening of the retainer plate opening, and a blocker having a blocking position in which it extends through said central area in blocking relation with said blocker-engaging surfaces of said retainer plate.

13. Knob-retaining mechanism as in claim 12 in which said blocker-engaging surfaces are generally cylindrical surfaces and said blocker is a generally cylindrical plunger supported axially in the knob sleeve.

* * * * *